US006378987B2

(12) United States Patent
Balakrishnan et al.

(10) Patent No.: US 6,378,987 B2
(45) Date of Patent: Apr. 30, 2002

(54) METHOD FOR REDUCING TORSIONAL DEFLECTIONS

(75) Inventors: Kumar Balakrishnan, Camas; Kenneth R Williams, Vancouver, both of WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/804,161

(22) Filed: Mar. 12, 2001

Related U.S. Application Data

(63) Continuation of application No. 09/550,925, filed on Apr. 17, 2000, now Pat. No. 6,238,039.

(51) Int. Cl.[7] ..... B41J 2/175
(52) U.S. Cl. ..... 347/49
(58) Field of Search ..... 347/37, 45, 84, 347/85, 86, 87

(56) References Cited

U.S. PATENT DOCUMENTS 5,250,957 A * 10/1993 Onozato ..... 347/7
5,798,777 A * 8/1998 Yoshimura et al. ..... 347/44

FOREIGN PATENT DOCUMENTS

EP 0824074 A2 * 2/1998 ..... B41J/2/175

* cited by examiner

*Primary Examiner*—N. Le
*Assistant Examiner*—Anh T. N. Vo

(57) ABSTRACT

A carriage for an ink-jet printer constrains torsional deflections by providing the carriage to writing-instrument latch interface features having a zero clearance interfit such that when opened, the writing-instrument latch allows individual writing-instruments to be accessed and when closed the writing-instrument latch reduces the carriage torsional deflections and increases the torsional stiffness of the carriage by providing a biasing force at each the interface feature.

11 Claims, 10 Drawing Sheets

METHOD FOR REDUCING TORSIONAL DEFLECTIONS

This is a continuation application Ser. No. 09/550,925 filed on Apr. 17, 2000 now U.S. Pat. No. 6,238,039.

BACKGROUND OF THE INVENTION

1. Field of the Invention

The present invention relates generally to ink-jet printing and, more specifically to an ink-jet pen carriage assembly having a torsional deflection control pen latching subsystem for increasing stiffness and maintaining accurate pen-to-paper alignment.

2. Description of Related Art

The art of ink-jet technology is relatively well developed. Commercial products such as computer printers, graphics plotters, copiers, and facsimile machines employ ink-jet technology for producing hard copy. The basics of this technology are disclosed, for example, in various articles in the Hewlett-Packard Journal, Vol. 36, No. 5 (May 1985), Vol. 39, No. 4 (August 1988), Vol. 39, No. 5 (October 1988), Vol. 43, No. 4 (August 1992), Vol. 43, No. 6 (December 1992) and Vol. 45, No. 1 (February 1994) editions. Ink-jet devices are also described by W. J. Lloyd and H. T. Taub in Output Hardcopy [sic] Devices, chapter 13 (Ed. R. C. Durbeck and S. Sherr, Academic Press, San Diego, 1988).

FIG. 1 depicts a hard copy apparatus, in this exemplary embodiment a computer peripheral, ink-jet printer, 101. A housing 103 encloses the electrical and mechanical operating mechanisms of the printer 101. Operation is administrated by an electronic controller 102 (usually a microprocessor or application specific integrated circuit ("ASIC") controlled printed circuit board) connected by appropriate cabling to a computer (not shown). It is well known to program and execute imaging, printing, print media handling, control functions and logic with firmware or software instructions for conventional or general purpose microprocessors or with ASIC's. Cut-sheet print media 105, loaded by the end-user onto an input tray 120, is fed by a suitable paper-path transport mechanism (not shown) to an internal printing station, or "print zone," 107 where graphical images or alphanumeric text is created. A carriage 109, mounted on a slider 111, scans the print medium. [Stationary, page-wide, ink-jet printhead arrays are also known in the art; page-size printhead arrays are contemplated.] An encoder subsystem 113, 114 is provided for keeping track of the position of the carriage 109 at any given time. A set of individual ink-jet pens, or print cartridges, 115X is mounted in the carriage 109 (described in more detail hereinafter with respect to FIG. 2B). Generally, in a full color system, inks for the subtractive primary colors, cyan, yellow, magenta (X=C, Y, or M) and true black (X=K) are provided; in some implementations an ink-fixer chemical (X=F) is also used. An associated set of replaceable or refillable ink reservoirs 117X is coupled to the pen set by ink conduits 119. Once a printed page is completed, the print medium is ejected onto an output tray 121. The carriage scanning axis is conventionally designated the x-axis, the print media transit axis is designated the y-axis, and the printhead firing direction is designated the z-axis.

For convenience of describing the ink-jet technology and the present invention, all types of print media are referred to simply as "paper," all compositions of colorants are referred to simply as "ink," ink-jet writing instruments are referred to as "pens" or "cartridges," and all types of hard copy apparatus are referred to simply as a "printer." No limitation on the scope of invention is intended nor should any be implied.

In essence, the ink-jet printing process involves digitized dot-matrix manipulation of drops of ink ejected from an ink-jet printhead onto an adjacent paper. The printhead generally consists of drop generator mechanisms and a number of columns of ink drop firing nozzles. Each column or selected subset (referred to in the art as a "primitive") of nozzles selectively fires ink droplets (typically each being only a few picoliters in liquid volume) that are used to create a predetermined print matrix of dots on the adjacently positioned paper as the pen is scanned across the media. A given nozzle of the printhead is used to address a given matrix column print position on the paper (referred to as a picture element, or "pixel"). Horizontal positions, matrix pixel rows, on the paper are addressed by repeatedly firing a given nozzle at matrix row print positions as the pen is scanned. Thus, a single sweep scan of the pen across the paper can print a swath of tens of thousands of dots. The paper is stepped to permit a series of contiguous swaths. Complex digital dot matrix manipulation is used to form alphanumeric characters, graphical images;, and even photographic reproductions from the ink drops.

In the state of the art, the nominal printhead-to-paper spacing is about one millimeter. Printer designers attempt to reduce pen-to-paper spacing as a means of improving print quality. However, carriage assembly torsional deflections can cause each printhead face, or "nozzle plate," to be off-kilter, limiting the attempt to narrow the gap between the printhead and the paper. As illustrated in FIG. 2, a pitch angle of the printhead relative to the plane of the paper in the printing zone is referred to as theta-x ($\theta x$), a roll angle is referred to as theta-y ($\theta y$), and printhead yaw is referred to as theta-z ($\theta z$). Any static or dynamic deflections during printing operations can result in dot placement errors and undesirable artifacts in the print.

Moreover, the problem becomes more complex when more pens are added to the printer design to accommodate higher print quality demands such as for very high resolution photographic reproductions where the ink-jet print is indistinguishable from a photolab darkroom developer process photograph, or multi-printhead, staggered, printhead array carriages for improving throughput. The larger the pen carriage, the greater the problem.

Most attempts to solve the problem focus on creating a more stable base platform for the hard copy apparatus as a whole. Such solutions often result in the use of heavier, more expensive, manufacturing materials or designs having a larger work space footprint.

Moreover, manufacturing tolerances allowed in springs, pen body datums, and the like parts of the assembly, can result in variations in torsional deflections in the carriage from assembly-to-assembly. Thus, another solution is required.

Other methods and apparatus are designed to stabilize the printhead alignment focus on the pen-to-bay interface mechanisms; see e.g., U.S. Pat. App. Ser. No. 08/878,489 by common assignee Williams, et al. for an INKJET PEN ALIGNMENT MECHANISM AND METHOD, or U.S. Pat. App. U.S. Ser. No. 09/431,712 by common assignor Williams, et al. for a DATUM STRUCTURE FOR COMPACT PRINT CARTRIDGE, or U.S. Pat. App. Ser. No. 09/431,711 by Heiles et al. for a UNITARY LATCHING DEVICE FOR SECURE POSITIONING OF PRINT CARTRIDGE(S) DURING PRINTING, PRIMING AND REPLENISHMENT (each assigned to the common assignee herein and incorporated herein by reference).

Therefore, there is a need for simplified mechanisms to reduce torsional deflections in ink-jet printhead carriage assemblies.

SUMMARY OF THE INVENTION

In its basic aspects, the present invention provides an ink-jet writing instrument carriage assembly for an ink-jet printer having a printing axis, a print media transport axis, and an ink drop firing axis, including: a carriage; a movable pen latch; a pen latch handle associated with the pen latch; and a biased handle retainer associated with the carriage, wherein the carriage and pen latch are each provided with complementary interfit devices such that when the movable pen latch is in a closed position with the retainer interlocked with the handle, the carriage and latch are held by the interfit devices with zero clearance interfit in at least one the axis such that torsional deflections of the carriage are thereby reduced.

In another basic aspect, the present invention provides an ink-jet writing instrument carriage assembly, including: a carriage for mounting at least one ink-jet printhead and for scanning across print medium positioned adjacently thereto such that the printhead is positioned with an ink drop nozzle side aligned for depositing ink drops on the print medium and a holddown side aligned for receiving a latching force; movable pen latch mechanisms for accessing the printhead mounted in the carriage when the latch mechanism is in an open position and for providing a force against a holddown side of the printhead when in a closed position; fixedly mounted to the carriage, latch retainer mechanisms for receiving the pen latch mechanisms via complementary interfit devices of each; mounted on the pen latch mechanisms, latch handle mechanisms for securing the pen latch mechanisms against the carriage and forcing a interfit between the complementary interfit device; and mounted on the carriage, biased handle retainer mechanisms for holding the latch handle mechanisms in the closed position, wherein the carriage and pen latch mechanisms complementary interfit devices provide pen pitch, pen roll and pen yaw counterforces when the pen latch mechanisms is in the closed position.

In another basic aspect, the present invention provides a method for reducing torsional deflections in an ink-jet writing-instrument carriage. The method includes the steps of : providing the carriage and writing-instrument latch with geometrically configured complementary interfit surfaces; and positioning the writing-instrument latch on the carriage against a bias such that when the writing-instrument latch is closed, counterforces to carriage torsional deflections which would affect the printhead-to-paper orientation and distance are established by the complementary interfit surfaces.

In another basic aspect, the present invention provides an ink-jet hard copy apparatus having a plurality of ink-jet writing-instrument for ejecting droplets of ink in a printing zone of the apparatus, the apparatus being defined by a scanning axis, a print media transport axis, and an ink drop firing axis, wherein the axes are mutually orthogonal, including: a writing-instrument carriage, mounted in the apparatus for selectively scanning the printing zone along parallel to the scanning axis, the carriage including a plurality of bays for locating the writing-instruments with respect to the printing zone; a movable writing-instrument latch having an open position for accessing the bays and a closed position for securing the writing instruments in the bays; a writing-instrument latch handle associated with the writing-instrument latch; and a biased handle retainer associated with the carriage, wherein the carriage and writing-instrument latch are each provided with complementary interfit devices such that when the movable writing-instrument latch in in the closed position with the retainer interlocked with the handle, the carriage and latch are held by the interfit devices with zero clearance interfit in at least one the axis such that torsional deflections of the carriage are thereby reduced.

Some of the advantage of the present invention are:

- it reduces torsional deflections of a scanning ink-jet printhead carriage without resorting to heavier, more expensive manufacturing materials;
- it is adaptable to a variety of implementations, including smaller footprint hard copy apparatus designs;
- it provides a low cost manufacturing solution;
- it provides a scalable design; and
- it can reduce torsional deflections of the assembly by approximately an order of magnitude.

The foregoing summary and list of advantages is not intended by the inventors to be an inclusive list of all the aspects, objects, advantages and features of the present invention nor should any limitation on the scope of the invention be implied therefrom. This Summary is provided in accordance with the mandate of 37 C.F.R. 1.73 and M.P.E.P. 608.01(d) merely to apprise the public, and more especially those interested in the particular art to which the invention relates, of the nature of the invention in order to be of assistance in aiding ready understanding of the patent in future searches. Other objects, features and advantages of the present invention will become apparent upon consideration of the following explanation and the accompanying drawings, in which like reference designations represent like features throughout the drawings.

The drawings referred to in this specification should be understood as not being drawn to scale except if specifically noted.

DESCRIPTION OF THE PREFERRED EMBODIMENT

Reference is made now in detail to a specific embodiment of the present invention, which illustrates the best mode presently contemplated by the inventors for practicing the invention.

Figure 2:
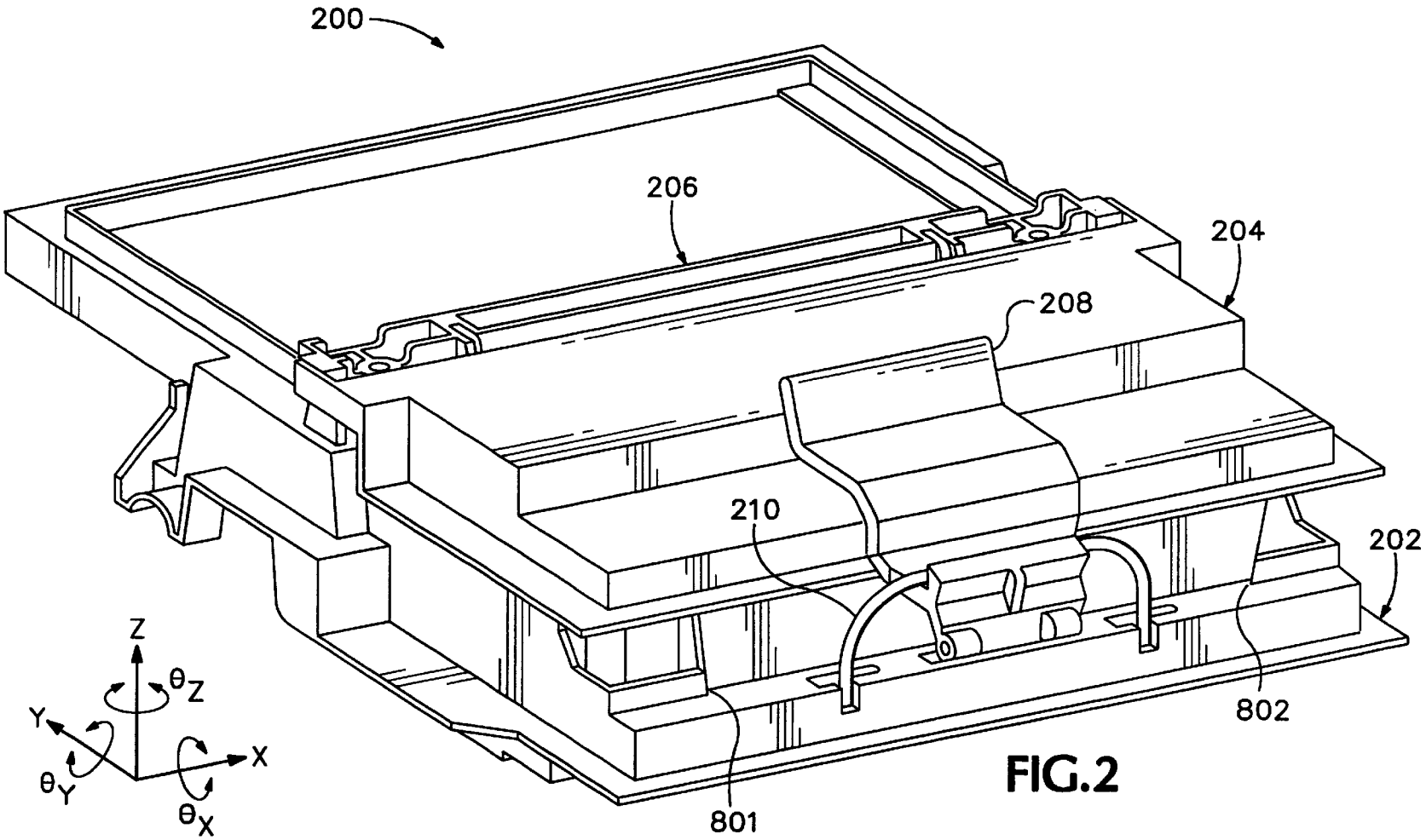
FIG. 2 is a perspective view of an ink-jet printhead carriage assembly in accordance with the present invention.
Figure 2A:
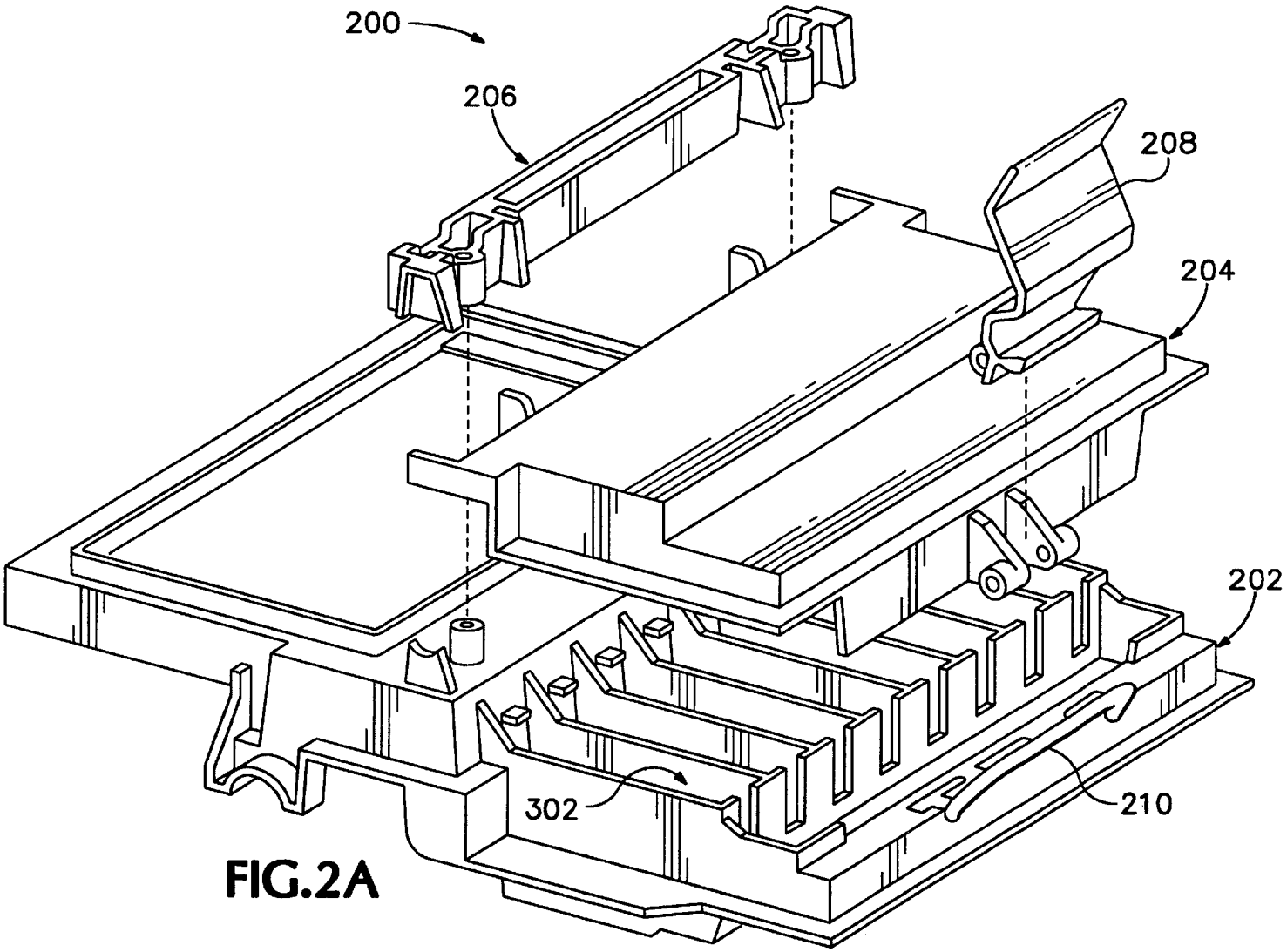
FIG. 2A is an exploded view of the ink-jet printhead carriage assembly of FIG. 2 in accordance with the present invention.

FIG. 2 is an ink-jet hard copy apparatus scanning carriage assembly 200 in accordance with the present invention; FIG. 2A shows an exploded view of the same assembly. It will be recognized by those skilled in the art that this embodiment represents one implementation and that many of the physical features employed in a scanning carriage in order to accomplish a variety of functions are tailored to each design. As such, only those features which comprise and aid in the understanding of the present invention are described in detail. No limitation on the scope of the invention is intended by the illustration of other features, nor should any such limitation be implied therefrom.

Figure 1:
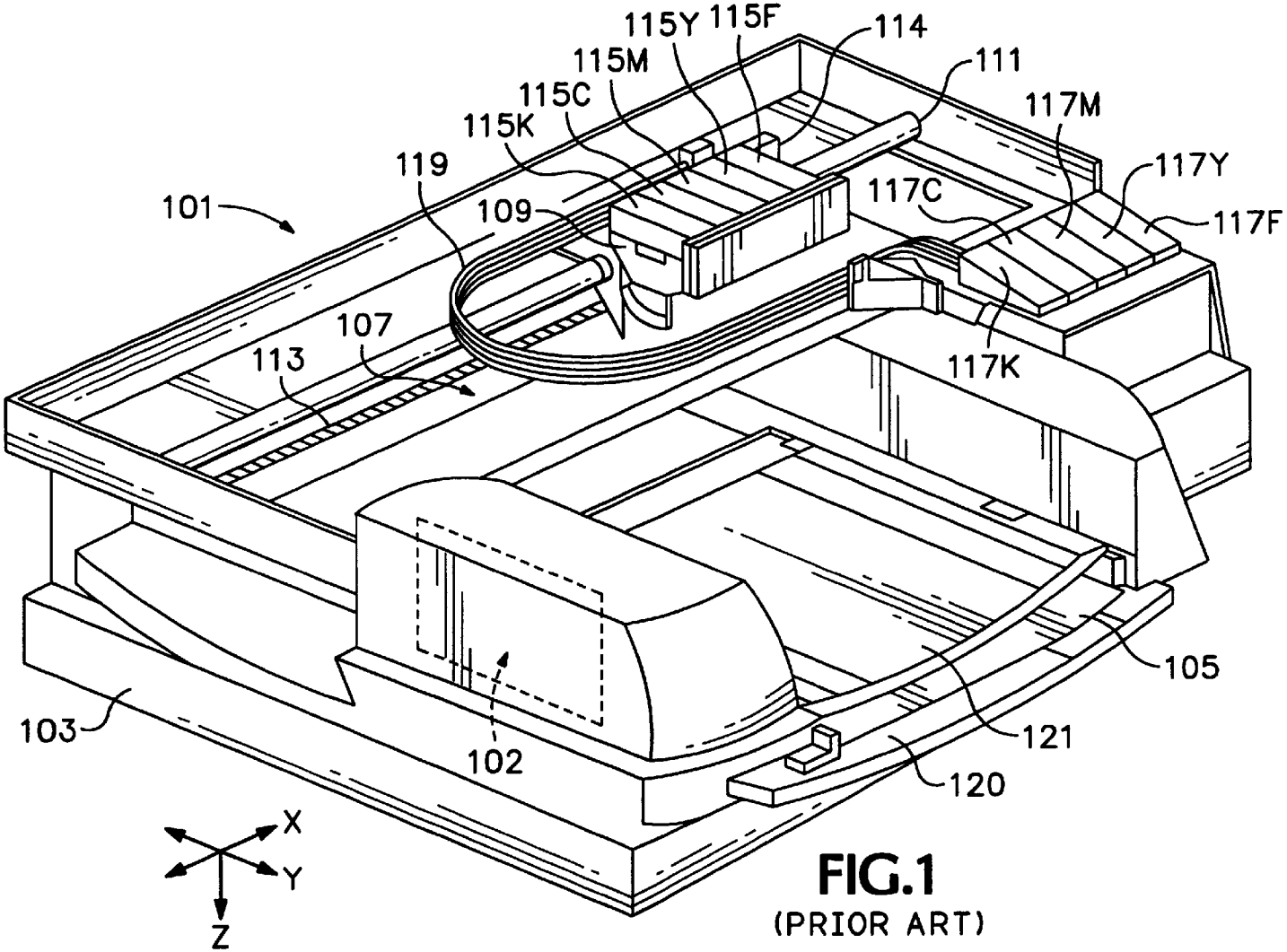
FIG.1 (PRIOR ART)
FIG. 1 (PRIOR ART) is an exemplary ink-jet printing apparatus having a scanning printhead carriage.

In this embodiment, there are five basic components of the carriage assembly 200:

(1) a pen carriage 202 (analogous to the prior art implementation of carriage 109 in FIG. 1), (2) a pen latch 204, (3) a latch retainer 206, (4) a latch handle 208, and (5) a handle retaining bail 210. Shown in the pen latch 204 closed position in FIG. 2, the latch handle 208 and bail 210 are configured to interact appropriately with a bias force in any known manner such that the latch 204 firmly seated against the carriage 202. In turn, the pen latch 204 is configured in any known manner to interact with pen surfaces to firmly seat the pens in the carriage 202.

However, the interface between the pen latch 204 and the pen carriage 202 uses specific features of the present invention to reduce substantially the torsional deflections of the carriage. Laboratory experimentation has shown that application of the present invention can result in a tenfold reduction of torsional deflections of a carriage assembly.

Figure 2B:
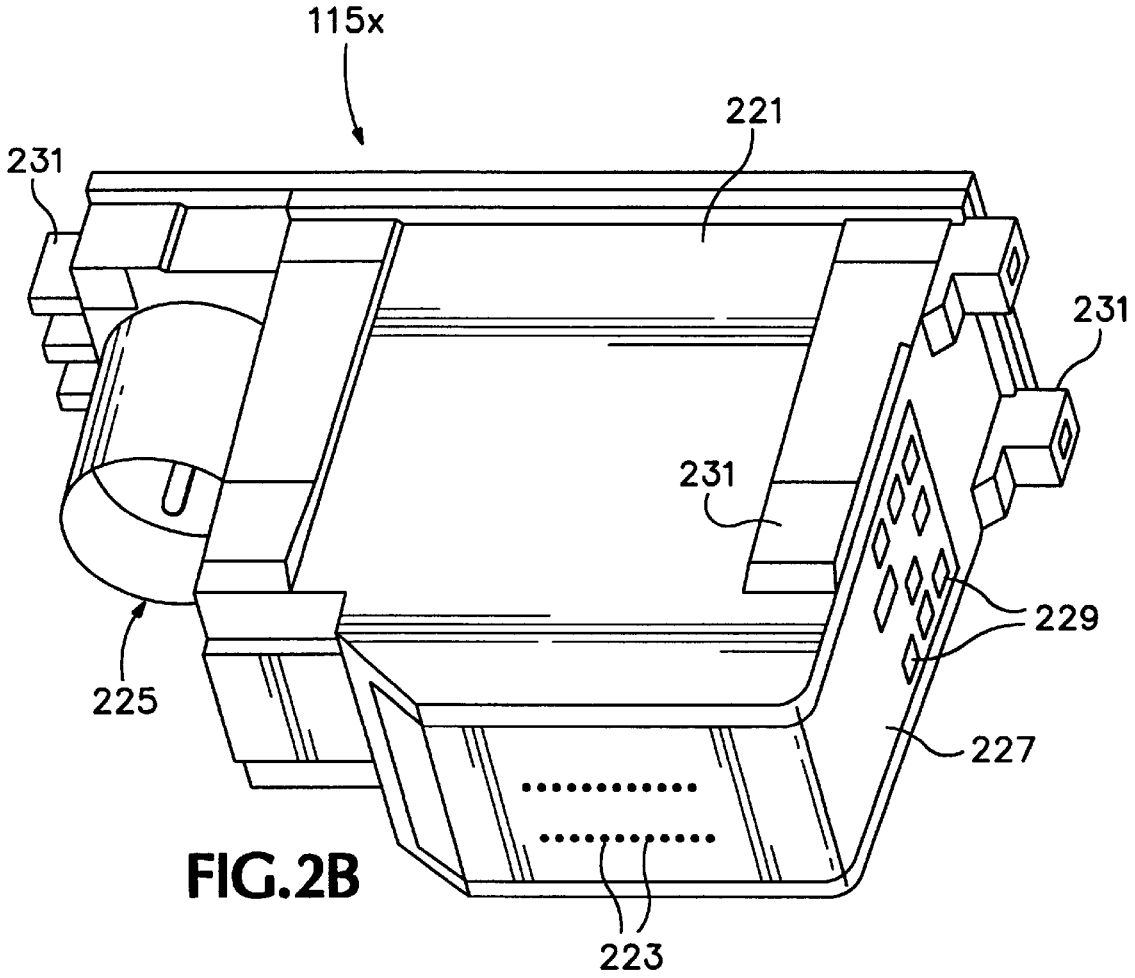
FIG. 2B is a perspective view of an exemplary ink-jet printhead cartridge insertable in the carriage as shown in FIGS. 2 and 2A.
Figure 3:
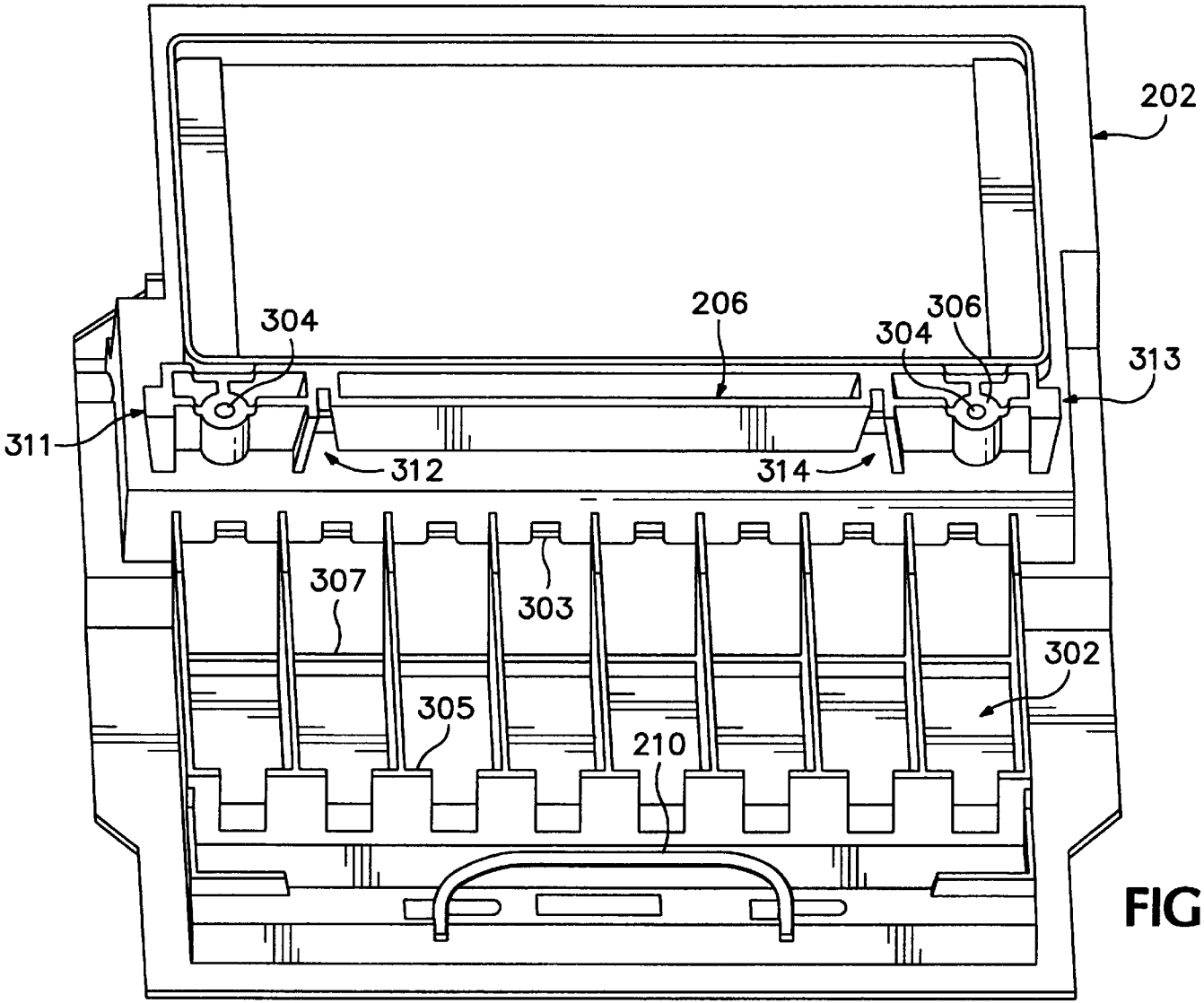
FIG. 3 is an overhead, perspective view (in partial cutaway) of a carriage component of the ink-jet printhead carriage assembly in accordance with the present invention as shown in FIG. 2.

FIG. 2B depicts an exemplary printhead cartridge, or "pen," 115X compatible with the eight pen bays 302 shown in FIGS. 2A and 3. Each pen 115X has a shell 221 for containing an internal, ink-accumulator chamber and associated ink flow regulator devices as would be known in the art. The chamber is fluidically coupled in the internal, printhead drop generator mechanisms for selectively ejecting droplets of ink from the nozzles 223. A fitment 225 is provided for fluidically coupling each pen 115X to an associated ink reservoirs 117X as shown in FIG. 1. A flexible circuit 227 has a plurality of electrical interconnects 229 for coupling each pen 115X to the controller 102 (FIG. 1 only). Datums 231 associated with positioning a pen 115X in its pen bay 302 are provided as needed.

Figure 4:
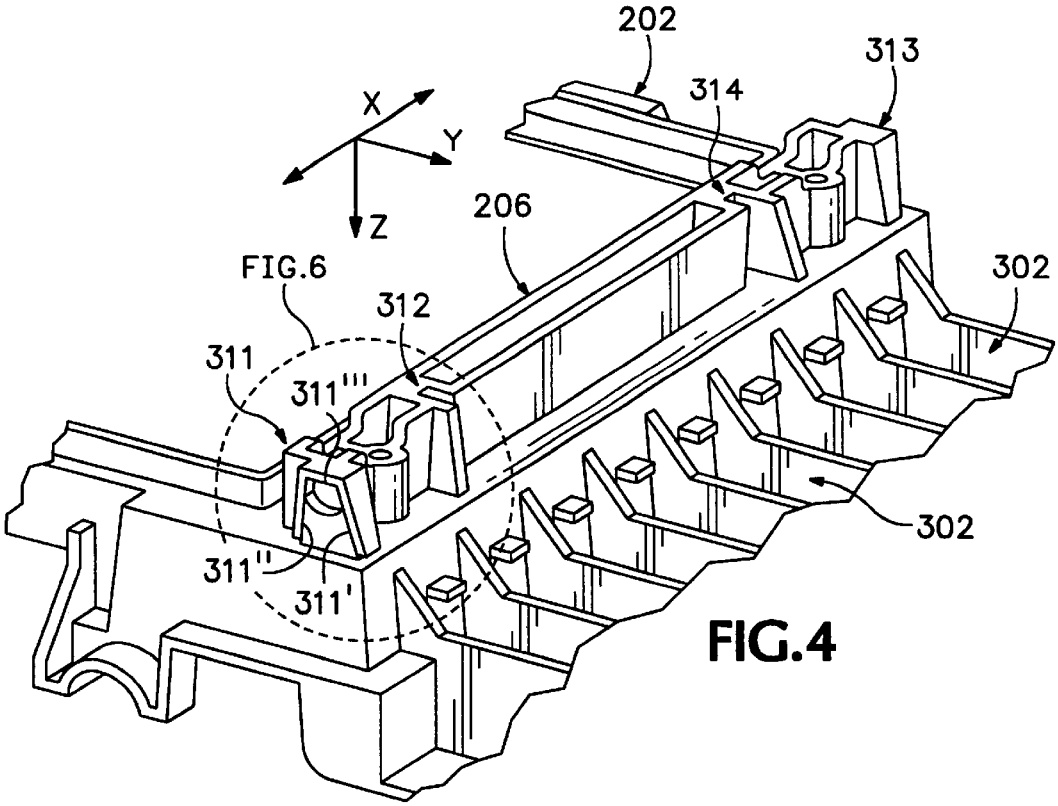
FIG. 4 is a side, perspective view (in partial cutaway) of a carriage component of the ink-jet printhead carriage assembly in accordance with the present invention as shown in FIGS. 2 and 3.

The pen carriage 202 is shown in FIGS. 3 and 4 with the pen latch 204 and its handle 208 removed. This implementation of a pen carriage 202 has eight pen bays 302, having appropriate pen mating features, or datums, 303, 305, 307 and spring retainers (not shown) as needed for any particular pen 115X (FIGS. 1 and 2B only). Similarly, the pen contact side of the pen latch 204 is provided with appropriate mating features or biasing springs (not seen in these views) as may be needed to secure each pen 115X in its associated bay 302.

Figure 5:
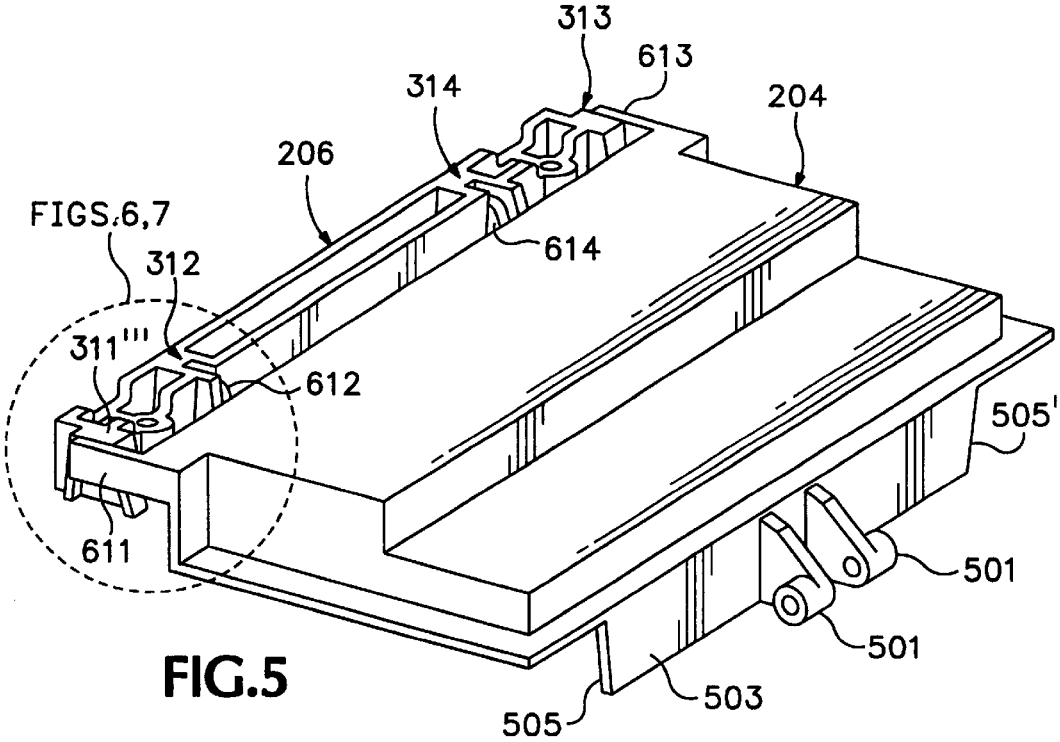
FIG. 5 is a perspective view of a latch component of the ink-jet printhead carriage assembly coupled to a latch retainer component in accordance with the present invention as shown in FIG. 2.
Figure 6:
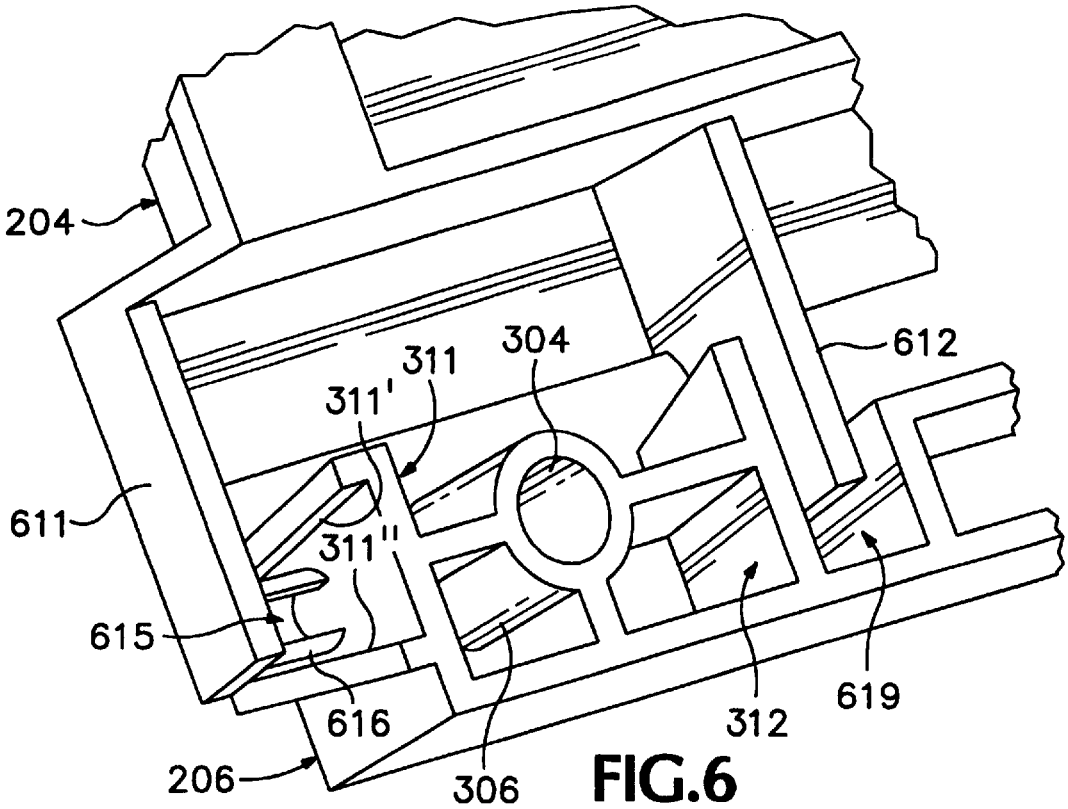
FIG. 6 is an illustration of close-up details of wedge control components of the ink-jet printhead carriage assembly in accordance with the present invention as shown in FIG. 2.
Figure 7:
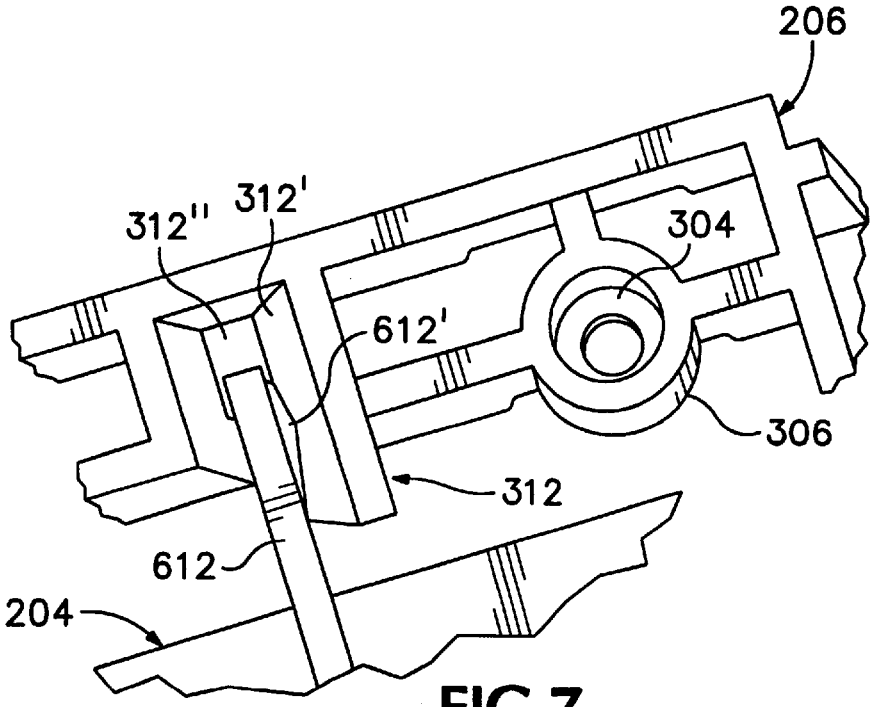
FIG. 7 is an illustration of close-up details of complementary latch and latch retainer components of the ink-jet printhead carriage assembly in accordance with the present invention as shown in FIG. 2.

The latch retainer 206 is fixedly mounted to the carriage 202 in a conventional manner, such as with fasteners (not shown) via capture holes 304 through mounting posts 306. In this embodiment, the latch retainer 206 is shown to be located approximately mid-carriage, in the upstream (i.e., toward the input paper supply) paper transit path y-axis direction of the pen bays 302, and generally lying in an x-axis plane (i.e., relatively reward with respect to the hard copy apparatus as depicted in FIG. 1). The retainer 206 is provided with four (relative left side and right side) wedge controls 311, 312, 313, 314. The left side outboard wedge control 311 is seen in more detail in FIG. 4 and FIG. 6; the right side outboard wedge control 313 is a mirror image construct. Each retainer wedge control 311, 312, 313, 314 is generally an open-bottomed trapezoidally-shaped receiver construct adapted for receiving and retaining respective members of the pen latch 204, such as protruding arm members, or tongues, 611, 612 as seen in FIG. 6 and FIG. 7. Inboard wedge controls 312, 314 receive associated inboard latch tongues 612, 614 with a line-to-line fit (referred to hereinafter more simply as "interfit") that is generally parallel to the y-axis, whereas the outboard wedge controls 311, 313 receive associated outboard latch tongue 611, 613 with an interfit that is generally parallel to the x-axis. As best seen in FIG. 5, the outboard wedge controls 311, 313 trapezoidal constructs are open outwardly along each side of the latch retainer 206 in the x-axis and the inboard wedge controls 312, 314 trapezoidal constructs are open outwardly on a side in the y-axis to facilitate receiving the respective associated latch tongues 611, 612, 613, 614.

The outboard tongues 611, 613 are each provided with a latch pivot 615 (FIG. 6 only). The latch pivot 615 has a generally cylindrical or spherical outer surface 617, facing inwardly along the x-axis, for facilitating the raising and lowering of the latch 204 to access the pen bays 302. Looking particularly to FIGS. 4 and 6, the pivot 615 has a outer diameter that is greater than the span of the upper reach of the wedge control 311 (see also, FIG. 9C, described in detail hereinafter). Therefore, as the latch pivot 615 is mated with the outboard wedge control 311, coupling the latch 204 to the retainer 206, the outer surface 617 will contact the inside front wall 311' and inside back wall 311" of the wedge control before the latch pivot outer surface reaches the inside top wall 311'". The same fit is provided between the right side, wedge control 313 and the right side, outboard latch tongue 613 (FIG. 5).

Looking again to FIG. 7, the left side (bottom view) inboard tongue 612 has an x-axis, outside face 612' that is generally conical shaped. This outside face 612' is configured such that will impact the outside inner wall 312' of the inboard wedge control 312 when the latch 204 is engaged with the retainer 206 and closed onto the pens 115X. The right side inboard tongue 614 is a mirror image construct. Note from FIGS. 6 and 7, that the y-axis reach the inboard tongue 612 into the inboard wedge control 312 provides a gap 619 such that there is no other interference when the latch 204 is raised and lowered during pen bay 302 access. FIG. 5 best displays a pair of integrated latch handle mounts 501 on a descending wall 503 of the pen latch 204.

Figure 8:
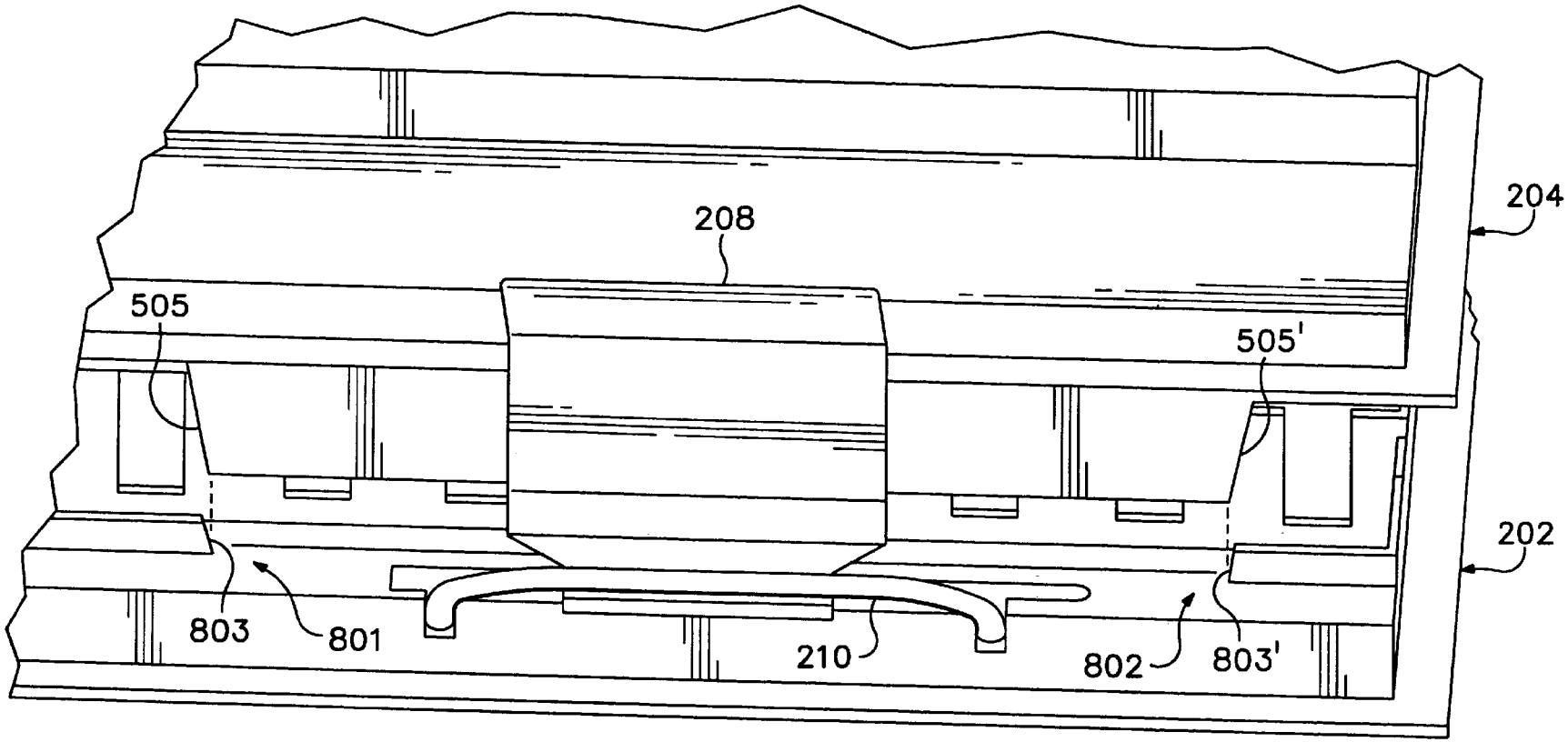
FIG. 8 is a cutaway, exploded, illustration of close-up details of latch and carriage components at the front of the ink-jet printhead carriage assembly in accordance with the present invention as shown in FIG. 2.

As shown in FIG. 8 (see also FIG. 2), another set of latch front wedge controls 801, 802 is provided on the carriage 202 proximate the latch handle 208 and bail 210 region of the carriage 202. The pen latch 204 descending wall 503 has an edge 505, 505' at each x-axis extremity thereof which received against a complementary ascending wall 803 of the carriage 202 to form the latch front wedge controls 801, 802. When mated, the latch front wedge controls 801, 802 provide x-axis linear constraint. complementary tongue-wedge control pairs, then capturing the bail 210 with the latch handle 208, and closing the latch 204 to secure ink-jet pens in the bays 302, will create contact forces between the tongues 611, 612, 613, 614 and respective wedge controls 311, 312, 313, 314, effectively "wedging" the fit between the latch and the retainer 206. In other words, relative motion, or more specifically, distortion of the carriage assembly—except for theta-x rotations—between the latch 204 and the retainer 206, which is securely fastened to the carriage, is substantially eliminated due to the forces set up by the wedge control components.

Figure 9:
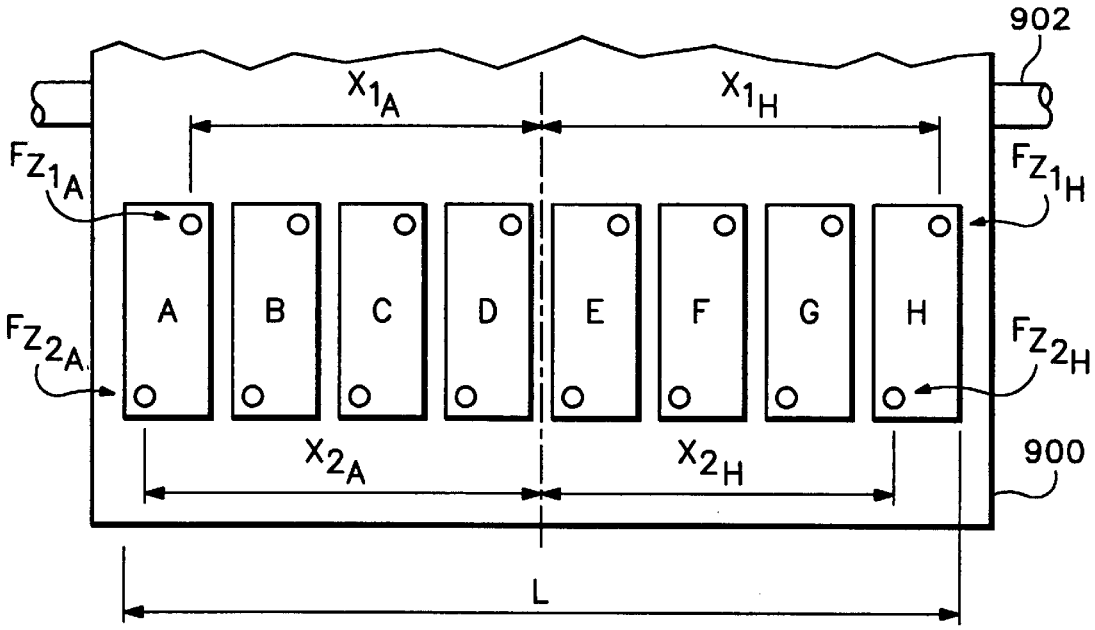
FIG. 9 is an example demonstrating known residual moment free body diagram as would be used in a deformation calculation for twist of a body.

FIG. 9 demonstrates the complexity of a large carriage which results in torsional deflections that can affect pen-to-paper alignment and distance and result in printing errors. Let A-H represent pens in a carriage 900 mounted for translation along the axis X—X of a rod 902. Thus, $$\sum M_0 = 0 = \sum_{n=A}^{H} (Fz1n * X1n) + (Fz2n * X2n) + M_R, \quad \text{(Equation 1)}$$

where it is known from mechanics of solids that "$M_r$," a the residual moment born by a body—in this case the carriage torsional twist, can be expressed as:

$$M_R = JG\theta \div L, \quad \text{(Equation 2)}$$

where J=section modulus, G=torsional modulus, θ=angular twist, and L is the distance from the latch rotational axis to the bail attachment point. Thus, if the section modulus J can be increased, angular twist θ can be decreased.

Figure 9A:
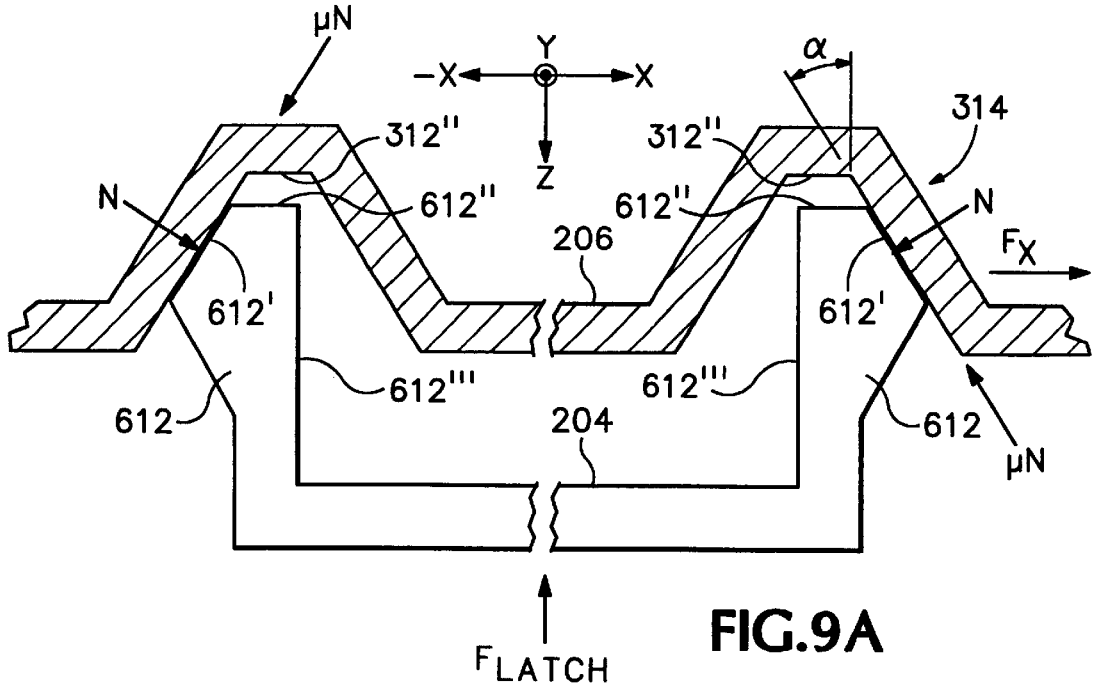
FIGS. 9A, 9B, and 9C are schematic free body diagrams depicting the forces in operation of wedge control components of the ink-jet printhead carriage assembly in accordance with the present invention as shown in FIG. 2.

The torsional deflection restraining affects of the present invention, accomplishing the requisite decrease in angular twist θ, can now be recognized. The latch 204 is assumed for the purpose of the following discussion to be closed as shown in FIGS. 2 and 8 such that a pen 115X is firmly sealed in each bay 302 (FIGS. 2A and 3) of the carriage 202. Referring also to FIG. 9A, with each conical face of the inboard latch tongues 612, 614 pressed against the outer wall of the associated latch retainer inboard wedge controls 312, 314, a constraining force, parallel to the carriage-scanning x-axis, is applied to the assembly 200 at each tongue. The normal force "N" at control face 612' for tongue 612 is at an angle "α" designed such that:

$$\alpha < \tan^{-1}\mu, \quad \text{(Equation 3)}$$

where $\mu$ is the coefficient of friction for the materials employed, to avoid sliding motion along face 612' due to applied forces, arrow "Fx," during translation of the carriage in the x-axis. In the present embodiment, α≈8°. A range of five to fifteen degrees is preferred but, in general, the wedge control surface angles should be chosen for a specific design to be self-locking. Note that the top surface 612" does not contact the inner upper surface 312" of inboard wedge control 312, nor does the inboard side wall 612'" of the tongue 612. The arrow labeled "$F_{Latch}$" represents the sum of the forces create when the latch 204 is secured to the carriage 202 via the handle 208 and bail 210.

Figure 9B:
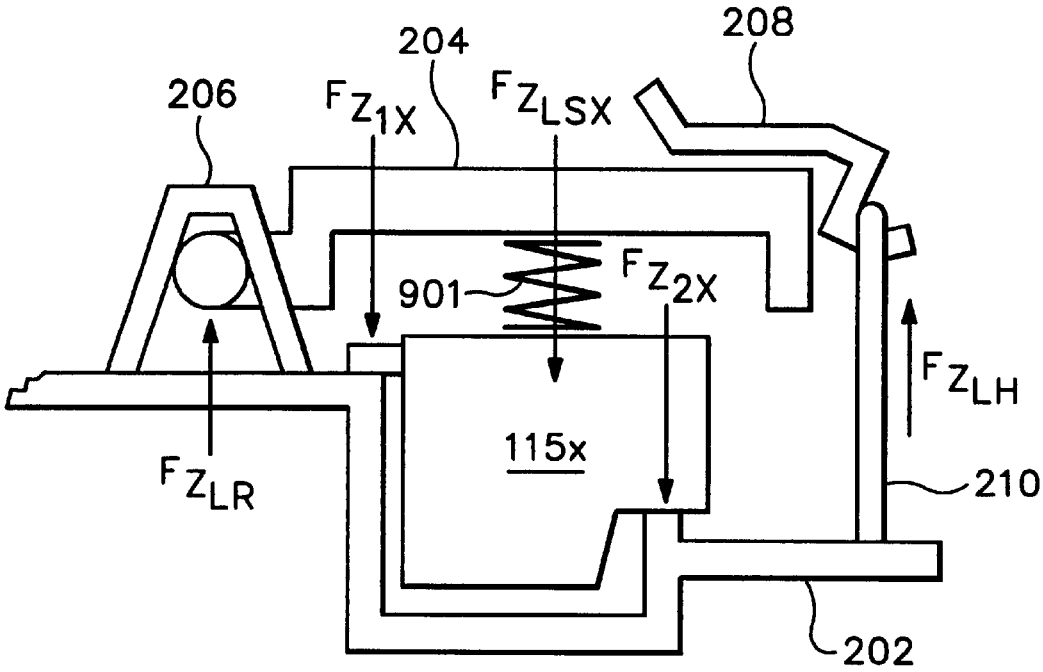

FIG. 9B schematically demonstrates representative forces in the z-axis extant when the latch 204 is closed on the pens 115X:

$F_{ZLR}$=forces at the latch retainer, $F_{Z1LX}$=forces at the latch at first extremity datums 231 (FIG. 2B) of each pen 115X, $F_{ZLSX}$=forces at the latch spring 901 provided for each pen, $F_{Z2LX}$=forces at the latch at an opposite extremity datums of the pen, and $F_{ZLH}$=forces at the latch handle.

Figure 9C:
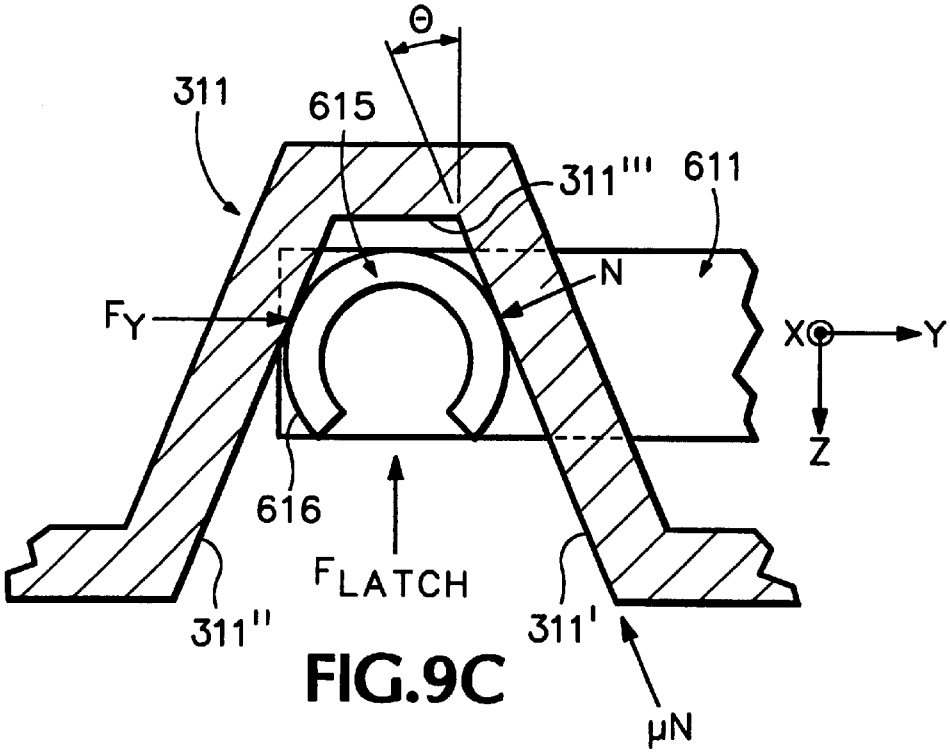

Similarly, and now referring also to FIG. 9C, with the latch pivot 615 outer surface 616 pressed into the latch retainer outboard wedge controls 311, 313 on each side of the latch 204 (with only control surfaces—walls 311' and 311"—seen in this view), constraining forces, "Fly," parallel to the paper transport y-axis are applied to the assembly 200 at each. As such, y-axis relative motion and theta-y and theta-z deflections are opposed by the constraining forces.

As such, theta-y and theta-z carriage deflections are directly opposed by the constraining force. Similarly, the conical faces 811, 822 on the descending wall 502 mating with the front wedge controls 801, 802 cause a constraining forces parallel to the paper transport y-axis toward the relative front of the carriage. This sets up theta-y and theta-z deflection opposition. Thus, employing the present invention, carriage twist and deformations are substantially reduced. In other words, the carriage-latch assembly torsional stiffness has be substantially increased. As a result, pen printhead pitch, θx, printhead roll, θy, and printhead yaw, θz, are all provided for with counter-forces automatically employed when the pen latch 204 is shut and locked using the bail 210 and latch handle 208, positioned as shown in FIGS. 2 and 8.

Thus, print quality is more free of artifacts. Therefore, the present invention provides a carriage for an ink-jet printer constrains torsional deflections by providing carriage to pen latch interface features having a zero clearance interfit such that when opened, the pen latch allow individual pens to be acessed and when closed the pen latch reduces the carriage torsional deflections and increasing the torsional stiffness of the assembly by providing biasing forces at each the interface feature. Stated more generally, by providing the carriage and pen latch will geometrically configured complementary interfit surfaces wherein when the pen latch is closed, counterforces to carriage torsional deflections which would affect the printhead-to-paper orientation are established.

The forgoing description of the preferred embodiment of the present invention has been presented for purposes of illustration and description. It is not intended to be exhaustive or to limit the invention to the precise form or to exemplary embodiments disclosed. Obviously, many modifications and variations will be apparent to practitioners skilled in this art. For example, other geometric specific shapes and orientations for the wedge control constructs can be designed for a specific carriage. The invention is not limited to scanning carriages; page-wide and page-size ink-jet printhead carriages are adaptable to the present invention. Moreover, while no pen bay side bias elements, such as springs, have been shown, it will be recognized by those skilled in the art, that they can be employed as needed. Similarly, any process steps described might be interchangeable with other steps in order to achieve the same result. The embodiment was chosen and described in order to best explain the principles of the invention and its best mode practical application, thereby to enable others skilled in the art to understand the invention for various embodiments and with various modifications as are suited to the particular use or implementation contemplated. It is intended that the scope of the invention be defined by the claims appended hereto and their equivalents. Reference to an element in the singular is not intended to mean "one and only one" unless explicitly so stated, but rather means "one or more. " Moreover, no element, component, nor method step in the present disclosure is intended to be dedicated to the public regardless of whether the element, component, or method step is explicitly recited in the following claims. No claim element herein is to be construed under the provisions of 35 U.S.C. Sec. 112, sixth paragraph, unless the element is expressly recited using the phrase "means for . . . "

What is claimed is:

1. A method for reducing torsional deflections in an ink-jet writing-instrument carriage including a movable writing-instrument latch having an open position and a closed position, the method comprising:

providing the carriage and the writing-instrument latch with geometrically configured complementary interfit surfaces; and positioning the writing-instrument latch on the carriage against a bias such that when the writing-instrument latch is in said closed position, counterforces to carriage torsional deflections which would affect printhead-to-paper orientation and distance are automatically established by the complementary interfit surfaces, wherein the providing the carriage and the writing-instrument latch with geometrically configured complementary interfit surfaces further comprises: interfitting the carriage and the writing-instrument latch such that both are held by the interfit surfaces with zero clearance interfit in at least one axis selected from said x- axis, y-axis, and z-axis such that torsional deflections of the carriage are reduced and wherein the interfit surfaces are devices that include at least one writing-instrument latch retainer on the carriage and each writing-instrument latch retainer includes wedge-configured receivers having receiver mating surfaces for providing y-axis constraint, and a protruding arm on the writing-instrument latch, the arm including a pivot having a surface wherein the pivot is interfit against the receiver mating surfaces such that the movable writing-instrument latch can be rotated between the open position and the closed position and the interfit provides y-axis, z-axis, theta-y and theta-z constraints for each writing-instrument.

2. The method as set forth in claim 1 wherein said torsional deflections are associated with writing-instrument yaw, pitch, and roll or any combination thereof.

3. The method as set forth in claim 1, comprising:

providing a plurality of said devices by disbursing the devices in the y-axis for holding the carriage and the latch with zero clearance interfit in at least two axes selected from said x-axis, said y- axis, and said z-axis.

4. The method as set forth in claim 1, comprising:

setting up counterforces to writing-instrument yaw torsional deflection tendencies of the carriage when the writing-instrument latch is in the closed position.

5. The method as set forth in claim 1, comprising:

setting up counterforces to writing-instrument roll torsional deflection tendencies of the carriage when the writing-instrument latch is in the closed position.

6. The method as set forth in claim 1, comprising:

setting up counterforces to writing-instrument pitch torsional deflection tendencies of the carriage when the writing-instrument latch is in the closed position.

7. The method as set forth in claim 1, comprising:

providing each writing-instrument latch retainer with wedge-configured receivers having receiver mating surfaces for providing x-axis constraint, and providing the arm with at least one face having a geometric configuration for establishing an interfit against at least one of the receiver mating surfaces such that in the closed position the interfit provides x-axis and z-axis constraints for each writing-instrument.

8. The method as set forth in claim 7, comprising:

providing the mating surfaces with surface angles wherein the contact between the surfaces forms an interlock.

9. The method as set forth in claim 1, further comprising:

providing a handle and a handle retainer for biasing the handle into a locked position when the writing-instrument latch is in the closed position; and providing an interfit with at least one wedge-configured receiver positioned on the carriage in a region proximate the retainer, the receiver having a mating surface for providing y-axis constraint, and the writing-instrument latch having at least one surface having a face having a geometric configuration for establishing the interfit against the mating surface when the writing-instrument latch is in the closed position such that the interfit provides y-axis, z-axis, theta-x, and theta-z constraints of each writing-instrument.

10. The method as set forth in claim 1, wherein the interfit provides writing-instrument pitch, writing-instrument roll and writing-instrument yaw counterforces when the movable writing-instrument latch is in the closed position.

11. A method for reducing torsional defections of an ink-jet pen carriage assembly for an ink-jet printer having a printing axis constituting a x-axis, a print media transport axis constituting a y-axis, and an ink drop firing axis constituting a z-axis, the assembly including a carriage, a movable pen latch having an open position and a closed position, a positioning mechanism associated with the movable pen latch, and a positioning mechanism retainer associated with the carriage, the method comprising:

providing the carriage and the movable pen latch with complementary interfit devices;

configuring said interfit devices such that when the movable pen latch is in a closed position, the carriage and the movable pen latch are held by the interfit devices with zero clearance interfit in at least one axis selected from said x- axis, y-axis, and z-axis such that torsional deflections of the carriage are reduced, and wherein the interfit devices include at least one pen latch retainer on the carriage and each pen latch retainer includes wedge-configured receivers having receiver mating surfaces for providing y-axis constraint, and a protruding arm on the pen latch, the arm including a pivot having a surface wherein the pivot is interfit against the mating surfaces such that the movable pen latch can be rotated between the open position and the closed position and the interfit provides y-axis, z-axis, theta-y and theta-z constraints for each pen.

* * * * *